United States Patent [19]

Smith

[11] 4,036,347

[45] July 19, 1977

[54] COIN TOTALIZER FOR DIFFERENT DENOMINATIONS

[75] Inventor: Barry L. Smith, Florissant, Mo.

[73] Assignee: UMC Industries, Inc., Stamford, Conn.

[21] Appl. No.: 677,310

[22] Filed: Apr. 15, 1976

[51] Int. Cl.[2] ..... G07F 5/08

[52] U.S. Cl. ..... 194/48; 194/1 L

[58] Field of Search ..... 194/1 M, 10, DIG. 3, 194/48, 1 L

[56] References Cited

U.S. PATENT DOCUMENTS 2,991,867 7/1961 Schuller ..... 194/DIG. 3

3,149,709 9/1964 Schuller ..... 194/48

*Primary Examiner*—Stanley H. Tollberg

*Attorney, Agent, or Firm*—Koenig, Senniger, Powers and Leavitt

[57] ABSTRACT

A coin totalizer having a strip wire operable by nickels, dimes and quarters to step a ratchet member forward from a zero position one step for a nickel, two for a dime, and five for a quarter, having a return spring for the trip wire and a return spring for the ratchet member, and having a range up to a total of $1.30, adapted to handle vending at three different prices with the capability of a differential of up to 70 cents between the lowest and highest prices.

7 Claims, 6 Drawing Figures

0
90
100
110
120
130
17
19
51
52
53
103
107
109
115
118
119
120
121
122
123
125
126
145
147
149
151
159
163
165
167
171
173
175
177
197
245
247
249
251
253
255
257
261
263
265
267
269
3
4
5
6

COIN TOTALIZER FOR DIFFERENT DENOMINATIONS

BACKGROUND OF THE INVENTION

This invention relates to coin apparatus and more particularly to a totalizer for totalizing the value of coins deposited in a vendor.

The invention involves an improvement on the coin totalizer unit shown in the Schuller U.S. Pat. No. 3,149,709 issued Sept. 22, 1964, which in turn involves modifications on the coin totalizer unit shown in the earlier Schuller U.S. Pat. No. 2,991,867 issued July 11, 1961.

In the coin totalizer shown in U.S. Pat. No. 3,149,709, a ratchet member (165) is advanced in steps by nickels, dimes and quarters falling in nickel, dime and quarter chutes, one step for each five-cent increment, and held in its advanced position against the bias of a ratchet return spring (clock spring 177). The advance is effected via a trip wire 17 driven down by a coin through a distance corresponding to the coin value secured to a pawl carrier carrying a driving pawl 159 engageable with the ratchet on an upward return stroke of the trip wire, which is biased to swing up by a trip wire return spring (clock spring 151). In the original version of this mechanism, the ratchet member had 12 teeth, and the price range of the totalizer was therefore limited to 60 cents. Also, in this original version, the differential between the lowest and highest prices was 55 cents. In a later version, as the prices of vended items increased, the number of teeth was increased to 20 to increase the price range of the unit to $1.00. In this later version, the differential between the lowest and highest prices was still 55 cents.

With continued increase in the price of vended items, it has become necessary further to increase the price range of the totalizer (e.g., up to $1.30), requiring an increase in the number of teeth of the ratchet member, and also to provide for an increased differential between the lowest and highest prices. It was found, however, that increasing the number of teeth created a problem in that it resulted in tighter winding of the ratchet return spring (clock spring 177) at the higher price levels (above $1.00) to the point where the force of this spring overcame the return bias of the trip wire return spring (clock spring 151) and prevented return of the trip wire. The problem cound not be solved simply by utilizing a stronger trip wire return spring, because the trip wire must be capable of swinging down, against the return bias of the trip wire return spring, under the weight of a dime (which is of relatively light weight), and it could not be solved simply by utilizing a weaker ratchet return spring.

SUMMARY OF THE INVENTION

Accordingly, among the several objects of the invention may be noted the provision of an improved totalizer of the type shown in U.S. Pat. No. 3,149,709 capable of reliably handling higher prices, e.g., up to $1.30; and the provision of such a totalizer providing an increased differential (e.g., 70 cents) between the lowest and highest prices.

In general, a coin totalizer of this invention comprises a ratchet member rotatable on an axis in a forward direction away from a zero position in steps corresponding to a unit coin value and in reverse direction back to zero position, and a pawl carrier rotatable on said axis away from a retracted position and in return direction back to retracted position. Trip means extending from the pawl carrier is movable downward by coins of different denominations dropping in respective coin chutes for rotating the pawl carrier in the direction away from its retracted position different amounts corresponding to the value of the different coins. This trip means is released after rotation by a coin for upward return and return of the pawl carrier to retracted position. The pawl carrier carries a driving pawl engageable with the ratchet member for stepping the latter forward upon rotation of the pawl carrier in return direction. A spring is provided for rotating the pawl carrier in return direction to return it and the trip means to retracted position. A second spring is provided for rotating the ratchet member in reverse direction to its zero position. A holding pawl is provided for the ratchet member. Reset means is provided for releasing the driving pawl and the holding pawl for resetting the ratchet member to zero position. The totalizer further includes a lockout member movable between a retracted position and an operative position, and a latch for said lockout member movable between a retracted position wherein the lockout member is free to move to its operative position and a latching position wherein it latches said lockout member in retracted position, the latch being biased to its retracted position. Means is provided on the ratchet member engageable with the latch when the ratchet member returns to its zero position for moving the latch against its bias to its latching position and determining the zero position of the ratchet member. The first spring is characterized in that the force exerted thereby on the pawl carrier for returning the pawl carrier and trip means to retracted position after a coin has driven the trip means down is lower than the force applied via the trip means by a coin of the lightest weight to be handled. The first spring exerts force on the ratchet member via the pawl carrier and driving pawl in opposition to the second spring when the trip means moves up and the pawl carrier and driving pawl step the ratchet member forward. The second spring is characterized in that the force exerted thereby on the ratchet member when the ratchet member is at its zero position is sufficient to overcome the latch biasing means for movement of the latch to its latching position when the ratchet member returns to its zero position but insufficient when the ratchet member is at its zero position and as it rotates forward to overcome the first spring, whereby the first spring is effective to return the pawl carrier and trip means to retracted position when the ratchet member is stepped forward.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 3:
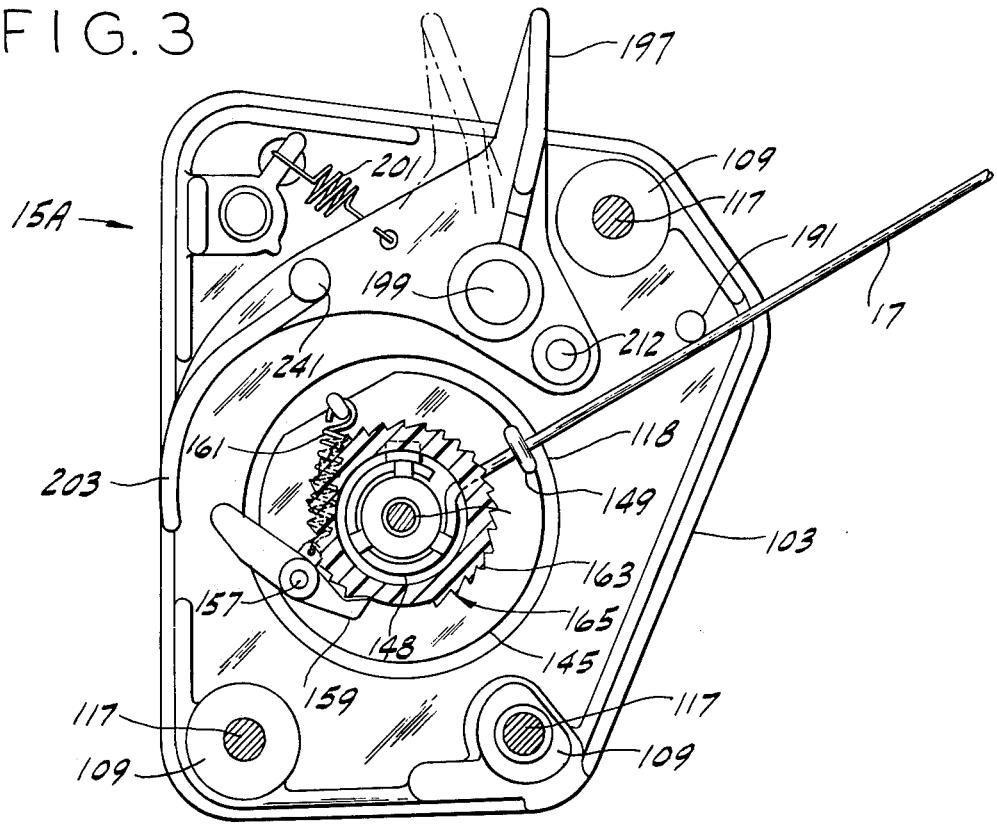

Referring to the drawings, there is generally indicated at 15A a totalizer unit of this invention, which is generally similar to the unit 15 shown in U.S. Pat. No. 3,149,709, with modifications as will appear. It is adapted to totalize the value of coins, more particularly nickels, dimes and quarters, dropping through nickel, dime and quarter chutes (not shown), having trip means constituted by a trip wire 17 (corresponding to the trip wire 17 of U.S. Pat. No. 3,149,709) pivoted to swing on the axis of a shaft 19 and having a finger 21 at its free end which extends across the three coin chutes the same as in said U.S. patent. The chutes are basically the same as illustrated in said patent, the arrangement being such that a coin dropping in any one of the chutes swings the wire 17 down from its raised retracted position of FIGS. 1, 3 and 4 through an angle corresponding to the value of the coin. The coin then escapes from the trip wire, the wire swings back up to its raised position, and on its upward swing it acts to index forward an indexing means constituted by a cluster of totalizer members or stops S1, S2 and S3 (rotate the cluster counterclockwise as viewed in FIG. 1) a number of steps corresponding to the value of the coin (one step for each 5 cents of value). Thus, a nickel indexes the cluster forward one step, a dime two steps, and a quarter five steps. The totalizer members S1, S2 and S3 control feelers, which are not shown herein since they correspond generally to the feelers F1, F2 and F3 shown in the aforesaid U.S. Pat. Nos. 2,991,867 and 3,149,709, the function of the feelers being to control vending operations at three different prices as determined by the setting of the members S1, S2 and S3.

Figures 2, 6:
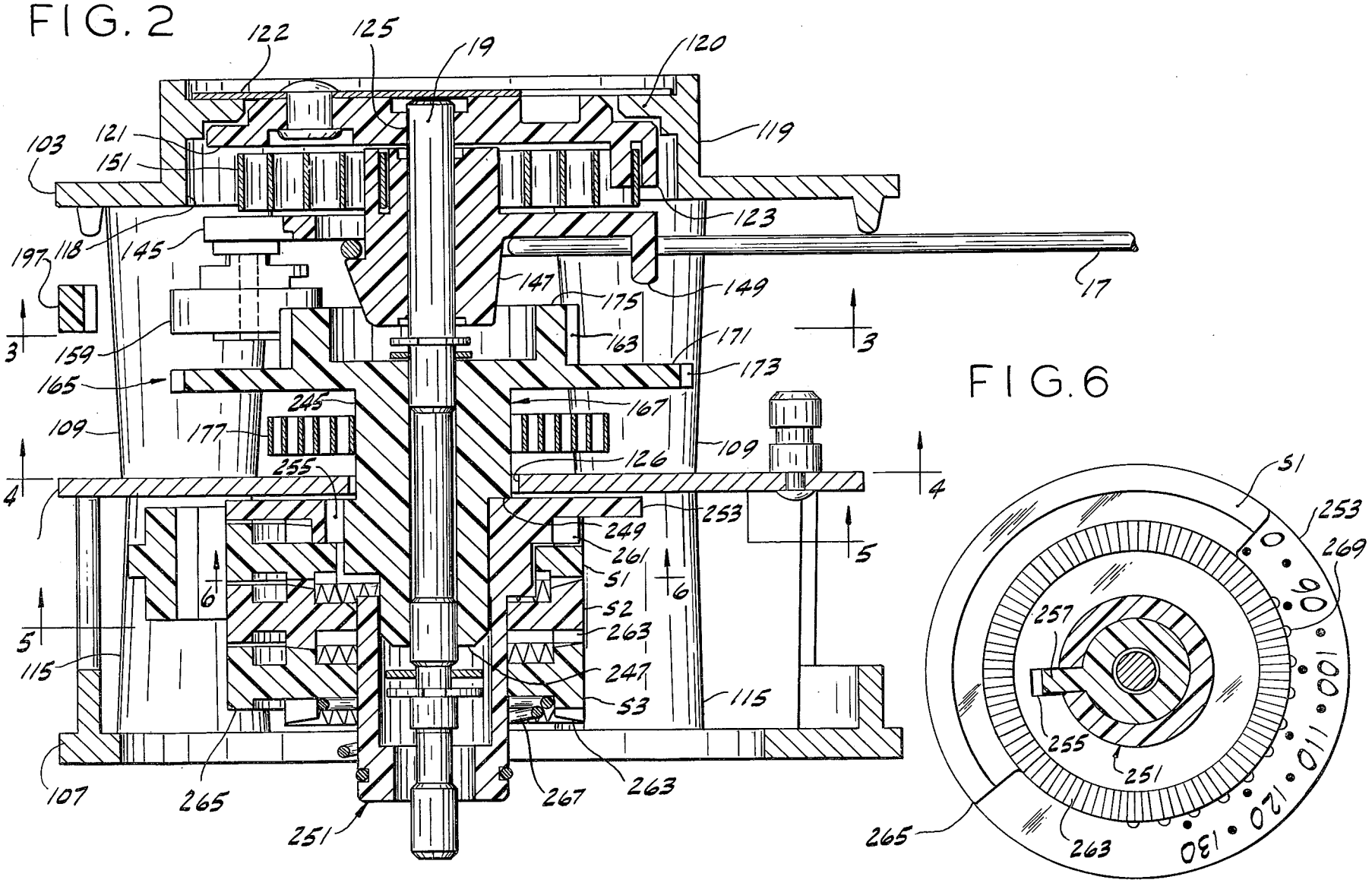
FIG. 2 is an enlarged horizontal section generally on line 2—2 of FIG. 1, showing the stops in place.
FIG. 6 is a section taken generally on line 6—6 of FIG. 2.

The totalizer unit 15A comprises a rear or base plate 103, an intermediate or center plate or partition 105, and a front cover plate 107. The base plate 103 is a die casting formed with three forwardly extending tubular spacer posts 109 (see FIGS. 2 and 3). The center plate or partition 105 is a sheet metal plate having three holes 113 registering with posts 109. The front cover plate 107 is a die casting formed with three rearwardly extending tubular spacer posts such as indicated at 115 in FIG. 2, the ends of which engage center plate 105. Plates 103, 105 and 107 are held in assembly by screws 117 received in the posts. All this corresponds to U.S. Pat. No. 3,149,709.

The base plate 103 has a circular opening 118 bounded by a rearwardly extending annular boss 119 having an internal annular radial seat 120. A bearing 121, which may comprise a molded plastic disk, is held in the boss on the inside of the seat by a retainer 122 riveted to the bearing on the outside of the seat. The bearing is molded with a trip wire spring anchor 123 on its inside face (its face opposite the retainer 122) and has a central hole 125 receiving one end of the shaft 19, the latter extending outward from base plate 103 through a hole 126 in the center plate 105. The outer end of shaft 19 is received in a hole in a cap (not shown) corresponding to the cap 129 of U.S. Pat. No. 3,149,709.

A pawl carrier constituted by a disk 145 (see FIGS. 2 and 3) has a hub 147 rotatable on the axis of totalizer shaft 19 immediately in front of bearing 121. Trip wire 17 is secured to the pawl carrier 145 as indicated at 148 and extends through a slot in an ear 149 on the pawl carrier. It is adapted to be swung downward by coins of different denominations (nickels, dimes and quarters) dropping in respective chutes (nickel, dime and quarter chutes such as indicated at NC, DC and QC in U.S. Pat. No. 3,149,709) for rotating the pawl carrier in the direction (clockwise) away from its retracted position of FIG. 3, different amounts corresponding to the value of the different coins. The trip wire is released after its rotation by a coin for its upward return and return of the pawl carrier to its retracted position. A clock spring 151 (see FIG. 2) has one end fixed to the hub 147 of the pawl carrier and its other end secured to the spring anchor 123 on bearing 121 for biasing the pawl carrier 145 and the wire 17 to rotate in return direction (counterclockwise as viewed in FIG. 3) to the raised retracted position of FIG. 3. The bearing/retainer assembly 121/122 is rotatable in the boss 119 to rotate the spring anchor 123 around the axis of shaft 19 for adjustment of the spring bias on the pawl carrier 145.

Clock spring 151 is located on the side of the disk 145 toward the bearing 121 and within the boss 119. Pivoted at 157 on the other side of the pawl carrier 145 is a driving pawl 159 (see FIG. 3). Pawl carrier 145 also carries a spring 161 biasing the pawl 159 toward an engagement with a series of ratchet teeth 163 on a ratchet member 165 (see FIGS. 2–4). This ratchet member 165 is rotatable on the axis of shaft 19 in a forward direction (which is counterclockwise as viewed in FIGS. 3 and 4) away from a zero position in steps corresponding to the unit coin value of 5 cents and in reverse direction (clockwise) back to zero. It has an integral hub 167 mounted on the totalizer shaft 19 independently of pawl carrier 145, and is free to rotate relative to the pawl carrier. Member 165 is so formed as to have a disk portion 171 peripherally formed with holding ratchet teeth 173. Teeth 163 are driving teeth, being formed on an annular flange 175 of smaller diameter than disk 171 projecting rearward from disk 171. As shown, there are 26 driving teeth 163, and 26 corresponding holding teeth 173. Ratchet member 165 is biased to rotate clockwise as viewed in FIGS. 3 and 4 by a second spring 177 (also a clock spring) having one end secured to the hub 167 of the ratchet member and its other end secured to a pin 178 which extends rearward from partition 105. The spring is confined by a tang 179 struck from the partition at one end of a slot 180 which extends down from the hole 126 in the center plate. Spring 177 is lighter and weaker than spring 151. Plate 105 has an opening 181 (see FIG. 5) above the hole 126. Ratchet disk 171 has a pin 182 extending forward therefrom terminating short of the center plate 105, with ample clearance between the forward end of the pin and the plate 105 to permit rotation of the ratchet member 165.

At 189 (see FIG. 4) is indicated a holding pawl engageable with the holding teeth 173 on ratchet member 165. This holding pawl is pivoted on a pin 191 extending between the base plate 103 and the center plate 105. It is biased toward engagement with teeth 173 by a spring 193 attached to a spring post 195 on center plate 105. Reset means comprising a reset lever 197 is pivoted at 199 on a pin extending from the base plate 103. The reset lever is biased by a spring 201 to swing clockwise on pivot pin 199 to the retracted position in which it appears in FIG. 4. It has a downwardly extending tail 203 engageable with the driving pawl 159 to release the latter (see FIG. 3) on swinging away from its retracted position. Reset lever 197 also carries a forwardly extending pin 212 engageable with the holding pawl 189. The arrangement is such that when the reset lever 197 swings counterclockwise away from its FIG. 4 retracted position, pin 212 moves up and releases holding pawl 189, and tail 203 on the reset lever 197 releases the driving pawl 159. When the pawls are released, clock spring 177 is adapted to rotate the ratchet member 165 clockwise to its zero position in which it appears in FIGS. 4 and 5.

At 215 (see FIG. 5) is indicated a lockout member constituted by a lever similar to the lockout lever 27 shown in U.S. Pat. No. 2,991,867. This lockout lever is pivoted at 217 on a pin extending between the front plate 107 and the center plate 105, and has a downwardly extending arm 219 with a curved lower end 221 movable into a lockout position above a feeler guide 223 for locking out of operation feelers such as indicated at F1, F2 and F3 in U.S. Pat. No. 2,991,867. It is adapted to be latched in the retracted position shown in FIG. 5 wherein its lower end is clear of the feelers by a latch 225 pivoted at 227 on a pin extending forward from the center plate 105. A spring 229 connected between the pin 227 and the lever 215 biases the lever 215 to swing to its feeler lockout position (wherein its lower curved end 221 is directly above the feeler guide 223). Lever 215 has an upper arm 231 extending toward the right from the pin 217 as viewed in FIG. 5 and latch 225 has a finger 233 for engagement by this arm 231 to latch the lever in its retracted position of FIG. 5 when the latch is in its latching position of FIG. 5 determined by its engagement with a stop pin 235 extending forward from the center plate 105. The latch 225 has a weight 237 which gravity-biases it to swing clockwise away from its latching position to a retracted position wherein finger 233 is clear of the arm 231 of lockout lever 215 to allow the latter to swing counterclockwise to its feeler lockout position under the bias of spring 229. The pin 182 on the ratchet disk 171 is engageable with a finger 239 on the latch 225, the arrangement being such that as the ratchet disk 171 rotates clockwise toward its zero position, pin 182 engages the finger 239 and thereby swings the latch 225 counterclockwise to its latching position determined by engagement of the latch with the pin 235, and this determines the zero position of the ratchet member 165. The reset lever 197 carries a pin 241 engageable with a lug 243 on the lockout lever 215 when the reset lever 197 is swung counterclockwise to hold the lockout lever 215 in its retracted position. The lug 243 extends rearward from the lockout lever 215 through the opening 181.

The hub 167 of the ratchet member 165 extends forward through the hole 126 in the center plate or partition 105, having a main body section 245 and a reduced diameter forward end extension 247 extending forward from an annular shoulder 249 at the forward end of the main body section. This shoulder is located slightly in front of the partition 105. A bushing 251, similar to the bushing 225 shown in the aforesaid U.S. Pat. No. 3,149,798, is mounted on the extension 247 of the hub between the partition 105 and the front plate 107. The bushing has a flange 253 at its rearward end, which engages the shoulder 249 to locate the bushing on the hub. The bushing has an axial keyway 255 extending forward from its rearward end receiving a key 257 on the hub extension 247 immediately in front of the shoulder 249 for keying the bushing to the hub 167 for rotation therewith, thus making the hub rotatable with the ratchet member 165.

Figure 1:
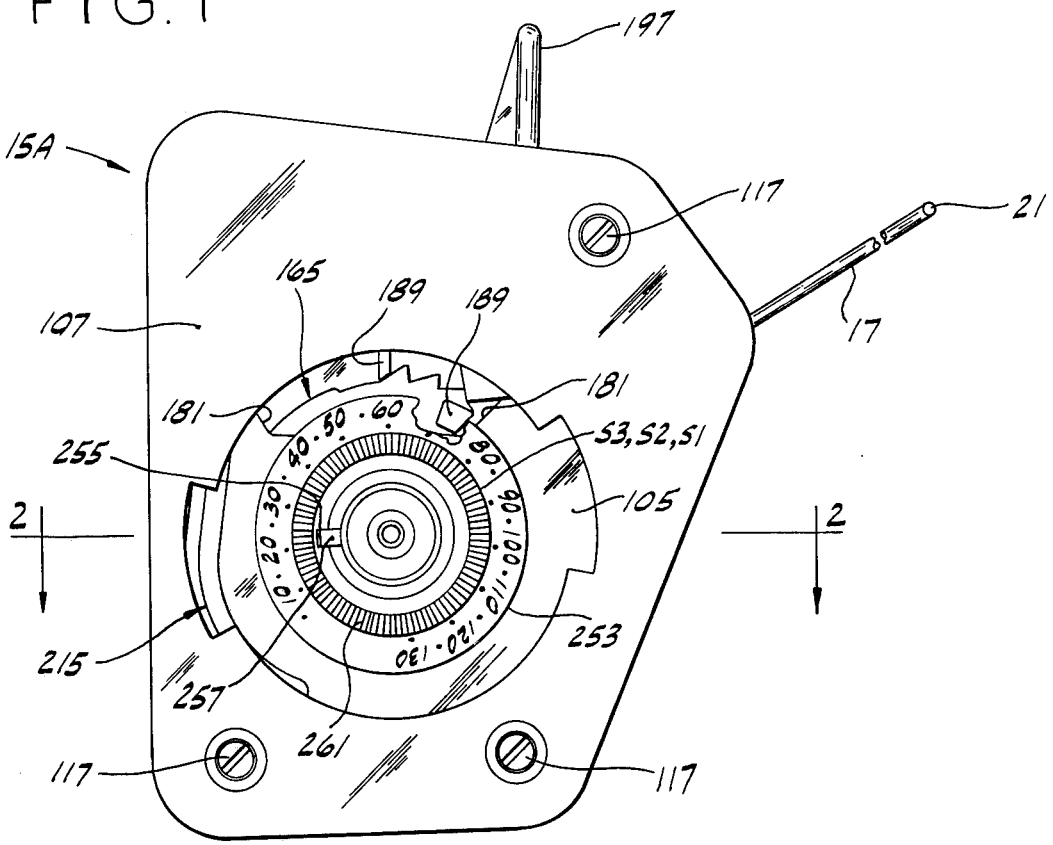
FIG. 1 is a front elevation of a coin totalizer of this invention, with a cluster of totalizer members or stops removed.

The front face of flange 253 has markings spaced at intervals corresponding to the spacing of the ratchet teeth and representing prices from 5 cents to 1 dollar and 30 cents in 5-cent increments (see FIG. 1). On the forward face of the flange surrounding the bushing are crown coupling teeth at 261 corresponding to the teeth 231 shown in U.S. Pat. No. 3,149,709. The members or stops S1, S2 and S3 (similar to the stops S1, S2 and S3 shown in said U.S. Pat. No. 3,149,709) fit rotatably on the bushing. The stops are identical, each comprising a disk having crown coupling teeth 263 on both faces thereof, and having a lobe 265 extending for slightly less than 180° of arc around the periphery of the disk. Stop S1 is the rear stop of the three, stop S2 is the middle stop, and stop S3 is the front stop. The stops are biased axially rearward on the bushing 251 by a spring 267. With the crown coupling teeth of stop S2 in mesh with the teeth on stops S1 and S3 and with the teeth on stop S1 in mesh with the crown coupling teeth 261 on the flange 253, and with the key 257 in the keyway 255, all three stops are locked to the ratchet member 165 for rotation therewith. The stops are independently rotatably adjustable on the bushing 251 by moving them outward on the bushing against the bias of the spring 267 to disengage the teeth, and then rotating them to a desired angular position. The stops S1, S2 and S3 have projections such as indicated at 269 which serve as pointers in conjunction with the markings on flange 253 for facilitating the adjustment of the stops.

As will be understood from U.S. Pat. Nos. 2,991,867 and 3,149,709, the stops S1, S2 and S3 are set in such angular positions relative to one another and to the bushing as to control feelers such as F1, F2 and F3 of U.S. Pat. No. 2,991,867 for controlling a vendor to vend at three different prices. With the driving pawl 159 and the holding pawl 189 having 26 teeth as herein illustrated, the prices may range (in 5-cent increments, up to $1.30, and the differential between the lowest price and the highest price may range up to 70 cents.

As will be further understood from U.S. Pat. Nos. 2,991,867 and 3,149,709, trip wire 17 is swung down by a nickel through a relatively short arc and is then released to swing back up to its retracted position under the bias of clock spring 151. On the return of the trip wire, pawl carrier 145 rotates counterclockwise through one step and the driving pawl 159 on the carrier rotates the ratchet member 165 and the cluster of members S1, S2 and S3 one step forward. The ratchet member 165 is latched in its advanced position by the holding pawl 189. The trip wire 17 is swung down twice as far by a dime, and on its upward return the driving pawl 159 indexes the ratchet member 165 two steps. The trip wire is swung down five times as far by a quarter, and on its upward return the driving pawl indexes the ratchet member five steps. Reset is effected by actuation of the reset lever 197 to release the driving pawl 159 from the ratchet member. With 26 driving teeth and 26 holding teeth on the ratchet member, credit up to $1.30 may be accumulated thereby enabling handling of prices up to $1.30.

Spring 151 is characterized in that the force exerted thereby on the pawl carrier 145 for returning the pawl carrier and trip wire 17 to retracted position after a coin has driven the trip wire down is lower than the force applied to the trip wire by a dime, which is the coin of the lightest weight to be handled (and which is of relatively low weight compared to a nickel and a quarter). Spring 151, in addition to exerting force on the pawl carrier, exerts force on the ratchet member 165 via the pawl carrier 145 and the driving pawl 159 in opposition to the spring 177 when the trip wire swings up and the pawl carrier and driving pawl step the ratchet member forward.

Figure 4:
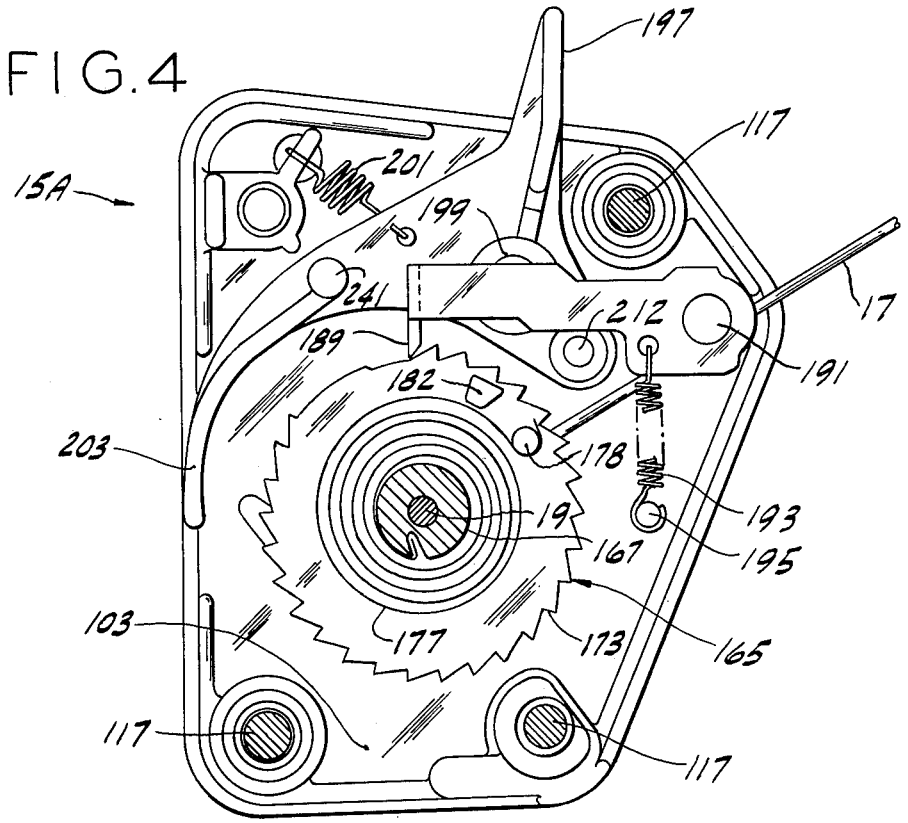
FIGS. 3, 4 and 5 are sections, on scale of FIG. 1, taken generally on lines 3—3, 4—4 and 5—5, respectively, of FIG. 2.
Figure 5:
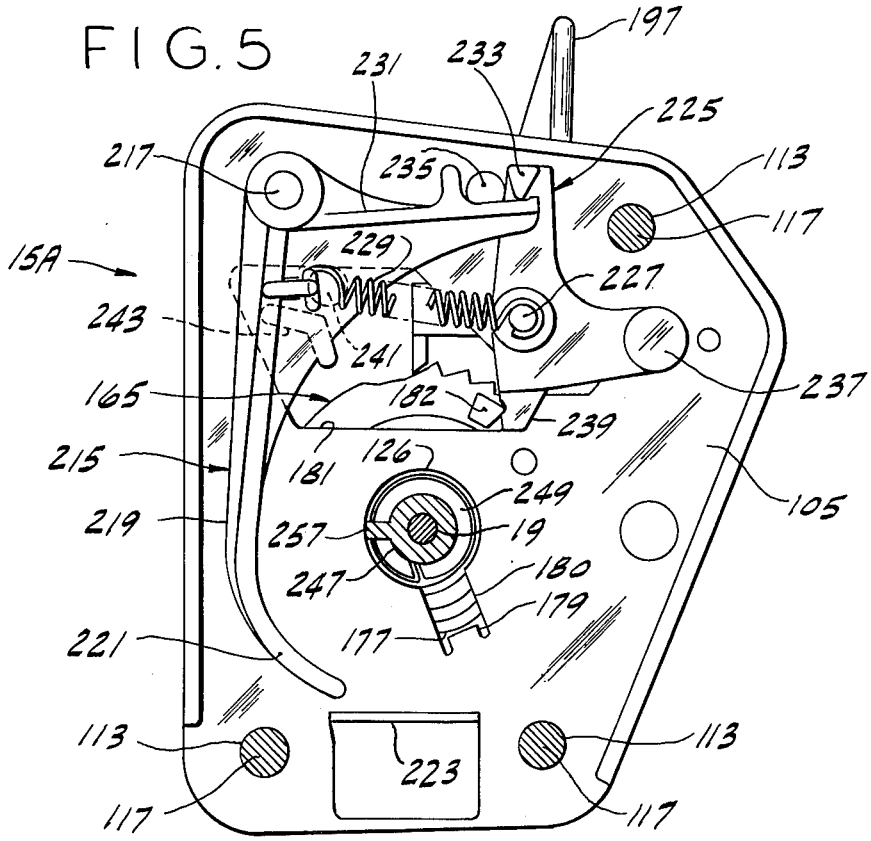

Spring 177 is characterized in that the force exerted thereby on the ratchet member 165 when the latter is at its zero position of FIGS. 4 and 5 is sufficient to overcome the bias of weight 237 on the latch 225 for movement of the latch to its latching position of FIG. 5 when the ratchet member returns to its zero position. But with the spring 177 being a clock spring coiled as shown, the force it exerts on the ratchet member is insufficient not only when the ratchet member is at its zero position but as it rotates forward away from zero position to overcome spring 151. Thus, spring 151 is effective to return the pawl carrier 145 and trip wire 17 to retracted position when the ratchet member is stepped forward even up to its maximum limit of $1.30, while still being weak enough to permit actuation by the coin, i.e., a dime, of the lightest weight to be handled.

In an actual physical embodiment of the invention, the spring 151 was made of Sandvik 2 R15 stainless steel strip about 0.006 inch thick and 0.100 inch wide, extra hardrolled and tempered, formed into a spiral having five coils (approximately) dimensioned to fit within a diameter of 1 inch, the diameter of the recess being slightly greater than 1 inch. The spring 177 was made of Sandvik 2 R15 stainless steel strip about 0.004 inch thick and 0.070 inch wide, extra hard-rolled and tempered, formed into a spiral having seven coils (approximately) dimentioned to fit within a diameter of 0.70 inch.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A coin totalizer comprising:

a ratchet member rotatable on an axis in a forward direction away from a zero position in steps corresponding to a unit coin value and in reverse direction back to zero position;

a pawl carrier rotatable on said axis away from a retracted position and in return direction back to retracted position;

trip means extending from said pawl carrier movable downward by coins of different denominations dropping in respective coin chutes for rotating the pawl carrier in the direction away from its retracted position different amounts corresponding to the value of the different coins, said trip means being released after rotation by a coin for upward return and return of the pawl carrier to retracted position;

a driving wheel on said pawl carrier engageable with said ratchet member for stepping said ratchet member forward upon rotation of the pawl carrier in return direction;

a first spring for rotating the pawl carrier in return direction to return it and said trip means to retracted position;

a second spring for rotating the ratchet member in reverse direction to its zero position;

a holding pawl for the ratchet member;

reset means for releasing the driving pawl and the holding pawl for resetting the ratchet member to zero position;

a lockout member movable between a retracted position and an operative position;

a latch for said lockout member movable between a retracted position wherein the lockout member is free to move to its operative position and a latching position wherein it latches said lockout member in retracted position;

means biasing the latch to its retracted position;

means on said ratchet member engageable with said latch when the ratchet member returns to its zero position for moving the latch against its bias to its latching position and determining the zero position of the ratchet member;

said first spring being characterized in that the force exerted thereby on the pawl carrier for returning the pawl carrier and trip means to retracted position after a coin has driven the trip means down is lower than the force applied via the trip means by a coin of the lightest weight to be handled, said first spring exerting force on the ratchet member via the pawl carrier and driving pawl in opposition to the second spring when the trip means moves up and the pawl carrier and driving pawl step the ratchet member forward, said second spring being characterized in that the force exerted thereby on the ratchet member when the ratchet member is at its zero position is sufficient to overcome the latch biasing means for movement of the latch to its latching position when the ratchet member returns to its zero position but insufficient when the ratchet member is at its zero position and as it rotates forward to overcome the first spring, whereby the first spring is effective to return the pawl carrier and trip means to retracted position when the ratchet member is stepped forward.

2. A coin totalizer as set forth in claim 1 wherein said trip means is operable by nickels, dimes and quarters, and the force exerted by the first spring on the pawl carrier is lower than the force applied via the trip means by a dime.

3. A coin totalizer as set forth in claim 2 wherein the ratchet member has at least 26 teeth spaced at intervals corresponding to five cents engageable by the driving pawl, whereby the totalizer may control operation of a vendor for prices up to $1.30.

4. A coin totalizer as set forth in claim 1 comprising supporting means including a partition, a shaft mounted in the supporting means extending from one side constituting the rear side of the partition through a hole in the partition to the other side constituting the front of the partition, said ratchet member being rotatable on the axis of the shaft at the rear of the partition and having an elongate hub extending through said hole to the front of the partition, said pawl carrier being rotatable on the axis of the shaft at the rear of the partition, and indexing means mounted on the hub in front of the partition for rotation with the ratchet member, said hub having a key at the front of the partition and said indexing means having a keyway receiving said key for coupling said indexing means to the hub.

5. A coin totalizer as set forth in claim 4 wherein said latch has a finger behind the partition and wherein said means on the ratchet member for engaging the latch comprises a pin extending forward from the ratchet member and terminating short of the partition, said pin being engageable with said finger.

6. A coin totalizer as set forth in claim 5 wherein said trip means is operable by nickels, dimes and quarters, and the force exerted by the first spring on the pawl carrier is lower than the force applied via the trip means by a dime.

7. A coin totalizer as set forth in claim 6 wherein the ratchet member has at least 26 teeth spaced at intervals corresponding to 5 cents engageable by the driving pawl, whereby the totalizer may control operation of a vendor for prices up to $1.30.

* * * * *

UNITED STATES PATENT AND TRADEMARK OFFICE

CERTIFICATE OF CORRECTION

PATENT NO. : 4,036,347

DATED : July 19, 1977

INVENTOR(S) : Barry L. Smith

It is certified that error appears in the above-identified patent and that said Letters Patent are hereby corrected as shown below:

Front page, item "[57]" entitled "ABSTRACT", line 1, "strip wire" should read -- trip wire --. Column 1, line 21, "wire 17" should read -- wire (17) --; line 23, "pawl 159" should read -- pawl (159) --. Column 3, line 21, "raised position" should read -- raised retracted position --. Column 7, claim 1, line 56, "driving wheel on" should read -- driving pawl on --.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*